US005800727A

United States Patent [19]

Croghan

[11] Patent Number: 5,800,727

[45] Date of Patent: Sep. 1, 1998

[54] BASE MOLD FOR CONCRETE POST

[76] Inventor: Morris T. Croghan, 106 Papineau Road, Fulford, Quebec, Canada, J0E 1S0

[21] Appl. No.: 748,198

[22] Filed: Nov. 12, 1996

[30] Foreign Application Priority Data

Dec. 7, 1995 [CA] Canada ..... 2164650
Jan. 31, 1996 [CA] Canada ..... 2168480

[51] Int. Cl.[6] ..... E02D 5/66

[52] U.S. Cl. ..... 249/51; 249/13; 249/48; 249/53 R; 249/155; 264/31

[58] Field of Search ..... 249/51, 13, 48, 249/53 R, 155

[56] References Cited

U.S. PATENT DOCUMENTS 4,673,157 6/1987 Wells ..... 249/13

*Primary Examiner*—David W. Wu
*Attorney, Agent, or Firm*—Eric Fincham

[57] ABSTRACT

A mold for forming a base for a concrete post, the mold having a side wall and a top wall characterized in that the top wall has a plurality of radially extending main slits extending from a central point to thereby form a plurality of flaps, the top portion being formed of a flexible material such that a tube may be inserted therethrough and retained in position by the flaps to permit casting a one piece post and base.

21 Claims, 4 Drawing Sheets

BASE MOLD FOR CONCRETE POST

BACKGROUND OF THE INVENTION

The present invention relates to a mold and more particularly, to a mold suitable for forming a base for concrete posts.

Concrete inground posts are installed to serve as supports for exterior structures such as decks, porches and out buildings. In a manner similar to a house foundation, they require a footing or base in order to disperse the downward force placed upon them, to stabilize them to lateral stress and in some areas to retard the action of frost heaving them upwardly.

In the art, it is a conventional practice to use a form for the posts and which form provides a round hollow manufactured paper or fiber tube. These 12' long fiber or paper tubes come in different diameters such as 6", 8" 10" etc. and are cut to the length required by the user.

A single manufactured 8" tube may in fact be 7½", 7¾", 8" or 8¼" in diameter, to facilitate compact shipping by placing 7½" tubes within 7¾" tubes within 8" tubes, etc.

Any base mold to be attached to a section of one of these tubes must therefore be either custom fitted to the tube on hand or have the ability to adapt to various diameters. The present practice is that the user will build a custom fitted mold for the base from wood. Thus it is well known for builders to construct a square of lumber and subsequently a plywood top is added. A hole is cut in the plywood to accommodate the tube and the box and tube are nailed together. The tube and box are then placed in the excavation and the excavation is subsequently back filled. Frequently reinforcing rods are placed in the tube and then the tube and the base are filled with concrete to provide a one piece concrete post and base (footing).

There are disadvantages to the above arrangement. It is a very time consuming process and the joint formed where the tube meets the base tends to be somewhat weak when subjected to lateral stress at the abrupt 90° tube to box joint. A multitude of tools and some skill are required for box fabrication.

SUMMARY OF THE INVENTION

It is an object of the present invention to provide a mold for a base for concrete posts which is lightweight, strong and adaptable to various diameter tubes.

It is a further object of the present invention to provide a mold for a base for a concrete post having a strong tapered tube to base joint.

It is a further object of the present invention to provide a mold for a base for a concrete post which is fast, economical, easy to use and requires no special tools or skill to install.

In one aspect of the present invention, there is provided a mold suitable for forming a base for a concrete post, the mold comprising a mold member having a side wall portion and a top wall portion, the top wall portion having means for forming a plurality of radially extending main slits extending from a central point to thereby form a plurality of flaps, the top wall portion being formed of a flexible material.

In a further aspect of the present invention, there is provided a mold suitable for forming a base for a concrete post, the mold comprising a mold member having a side wall portion and a top wall portion, the top wall portion having a plurality of radially extending main slits extending from a central point to thereby form a plurality of flaps, the top wall portion being formed of a flexible material.

In a still further aspect of the present invention, there is provided a setup for pouring a concrete post, the setup comprising a mold having a side wall portion and a top wall portion, the top wall portion having a plurality of radially extending main slits extending from a central point to thereby form a plurality of flaps, the top wall portion being formed of a flexible material, a tube extending upward from the mold, the flaps lying adjacent the tube, tabs underneath the tube and retaining the tube in position.

In a still further aspect of the present invention, there is provided a method of pouring a concrete post, the method comprising the steps of providing a mold having a side wall portion and a top wall portion, the top wall portion being of a flexible material having a plurality of radially extending main slits extending from a central point to thereby form a plurality of flaps, a plurality of alignment tabs associated with the flaps, inserting the tube through the top wall portion to thereby extend the flaps, engaging the alignment tabs with the tube to thereby align the tube to 90° to the base mold, affixing the flaps to the tube, placing the mold and the tube on a substrate, and pouring concrete in the tube to form a post having an integral base formed therewith.

In greater detail, the mold of the present invention is adapted for use with tubes which in turn act as molds for the post section. The tubes are widely referred to as "sono" tubes although it will be understood that the present invention may be practiced with any suitable mold for the posts and is not limited to one particular kind thereof.

The mold of the present invention may be formed of any suitable material having the desired characteristics including, for example, various metallic or paper or plastic or rubber materials. In practice, the mold is preferably formed of a suitable plastic material. Many known plastic materials may be used and indeed, the mold of the present invention could be manufactured using recycled materials. It suffices to say that suitable materials are well known to those knowledgeable in the art and it is only important that the mold have the strength to withstand back filling and containment of the concrete during the setting period and that the top portion thereof be sufficiently flexible to permit the insertion of the post tube.

The manufacture of the mold may conveniently be accomplished by injection molding. The main radial slits and secondary tab slits in the top wall may either be formed as a result of the injection molding process or alternatively, they may be cut within the top wall after the mold is formed and to this end, appropriate indicia or score lines could be provided.

The radial slits may follow straight radial lines or be of a curved or spiral nature.

The secondary slits forming alignment tabs may be cut or formed along the sides of the flexible flaps or cut or formed completely within the flexible flaps. The tabs are preferably arranged so that when the bottom of the inserted tube slides past them, the tabs will snap under the tube holing it aligned so as to be substantially 90° to the base mold.

Molded protrusions on the underside (tube contact side) of the flexible flaps may also be used to align the tube 90° to the base.

The upper side of the flexible flaps may be scored or have tiny linear protrusions that act as "tape gripping" lines.

The shape of the base mold is not critical and many different configurations such as circular, rectangular, square, polygonal, etc. may be employed.

The upper wall having the main slits formed therein can itself have various configurations. Thus, the upper wall may comprise a generally horizontal flat wall which is normal to the vertical side wall or alternatively, it may taper upwards to its center rising above the sidewalls to have a conical or dome shaped configuration. The top wall could also extend downwardly to its center below the top of the sidewalls as an inverted cone.

In one embodiment, the base mold will have a side wall which is tapered inwardly and which may be ribbed to enhance side wall strength. This ribbing may extend completely or only part way up the side wall of the mold.

Further, sidewalls may have small holes or slits in them to allow for the introduction of reinforcing bars across the interior of the base mold.

The mold may include means for securing it in place to avoid dislodging on back filling. To this end, there may be provided a series of holes in the mold bottom rim to allow it to be staked in place.

Having thus generally described the invention, reference will be made to the accompany drawings illustrating an embodiment thereof, in which:

DESCRIPTION OF THE PREFERRED EMBODIMENTS

Figure 1:
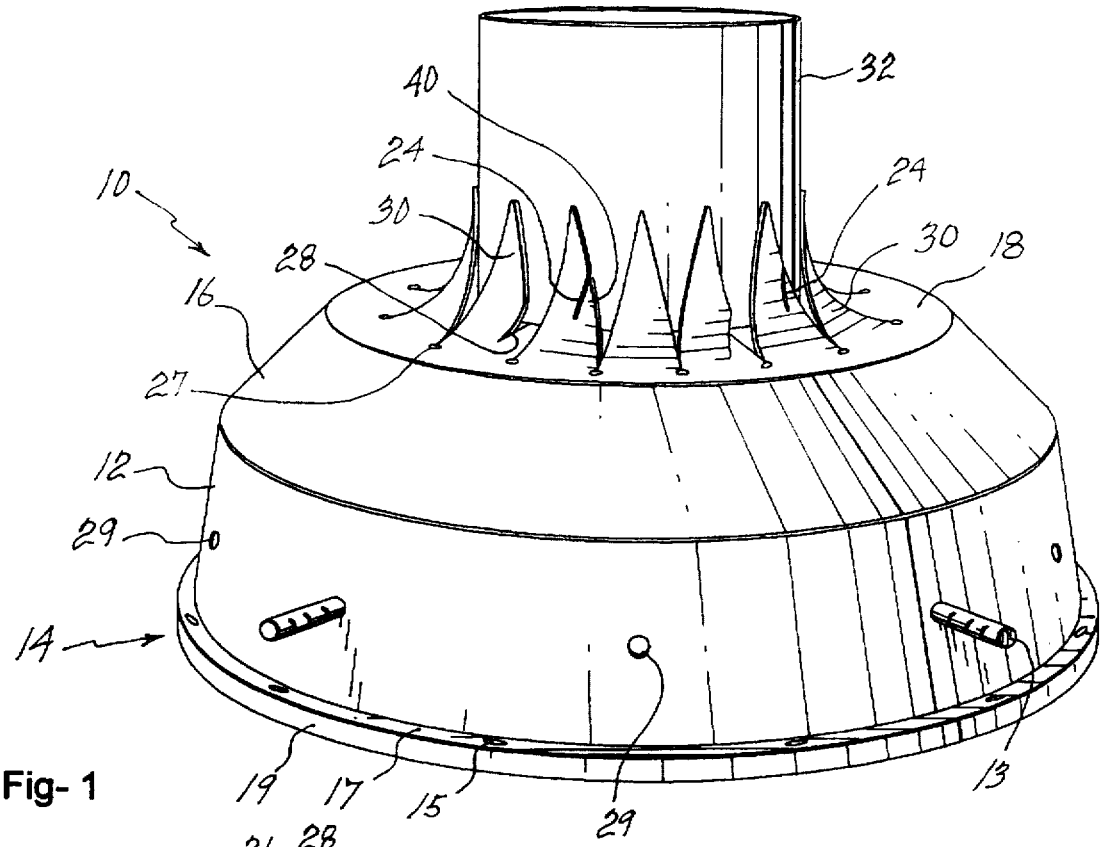
FIG. 1 is a perspective of a concrete post base mold with a post mold inserted therein.

Referring to the drawings in greater detail and by reference characters thereto, there is illustrated in FIG. 1 a concrete post base mold which is generally designated by reference numeral 10.

Concrete post base mold 10 has a lower cylindrical side wall 12 having apertures 29 formed therein and having at its bottom peripheral edge a lower side wall rim 14. Side wall rim 14 is formed to have a plurality of apertures 15 formed in a horizontal portion 17 from which extends a downwardly extending flange 19.

At the upper peripheral edge of lower side wall 12 there is provided an upper side wall 16. Upper side wall 16 is of a frustroconical configuration and extends inwardly.

Extending inwardly from the upper marginal edge of upper side wall 16 is a top wall 18 which, in the illustrated embodiment is of a generally planar nature and extends in a horizontal direction.

Top wall 18 has an aperture 19 (FIG. 2) located centrally thereof from which extend a plurality of radially extending slits. In this respect, there are provided four main slits 20 extending radially from aperture 19 and which main slits 20 are separated by substantially 90° from each other. The slits are all substantially equidistant.

There are a further set of four main slits 22 which also extend radially from aperture 19 and which are located adjacent slits 20 and separated therefrom by approximately 30°. It will be noted that main radial slits 22 each has at least one secondary side slit 24 extending therefrom. All secondary side slits 24 are substantially identical.

A further set of four radial slits generally designated by reference numeral 26 are located between radial slits 20 and 22 and separated from each by approximately 30°. Radial slits 26 are substantially the same length as radial slits 20 and 22.

It will be noted that radial slits 26 also include secondary side slits 28; however, minor side slits 28 are located further from the distal tip end of radial slits 26 compared to the distance minor side slits 24 are located from the distal tip end of radial slits 22.

The arrangement is such that a plurality of flaps 30 are formed by the arrangement of the main radial slits 20, 22 and 26 and a plurality of tabs 40 are formed by the arrangement of the secondary side slits on flaps 30.

Figure 2:
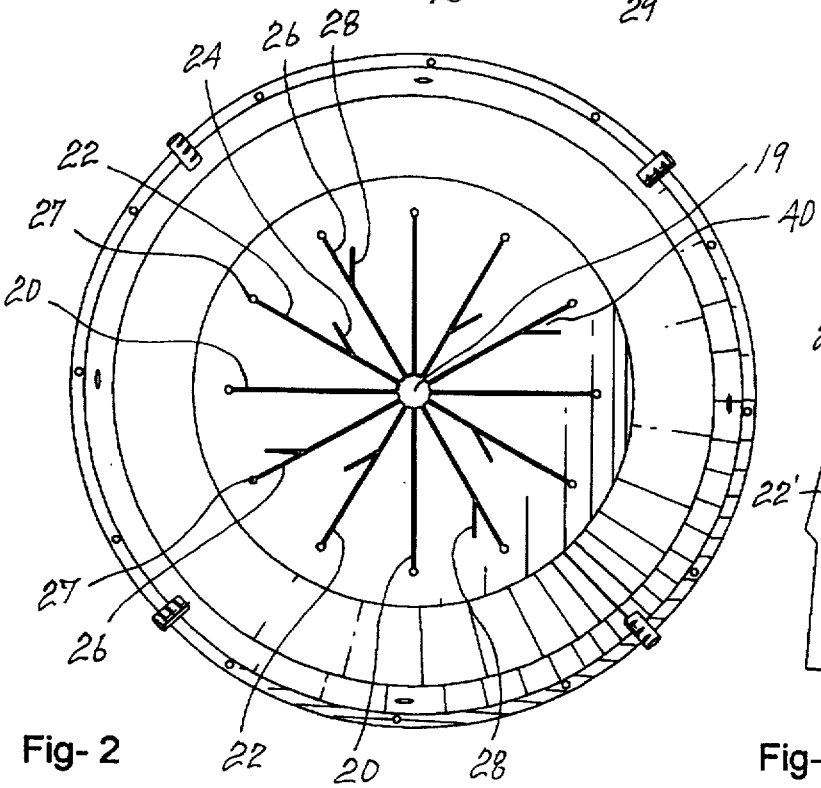
FIG. 2 is a top plan view of a concrete post base mold.

As shown in FIG. 2, slits 20, 22 and 26 may terminate in small apertures 27 to thereby prevent tearing.

In the practice of the invention, and as shown in FIGS. 3, 4, 5 and 6, a conventional round tube form generally designated by reference numeral 32 is moved relative to concrete post base mold 10 such that flaps 30 are forced upwardly. The tube is moved upwardly through the flaps 30 until the bottom peripheral edge of tube 32 is substantially at a level slightly above top wall 18 at the upper tip of tabs 40. A little further movement will permit only the tabs 40 to snap under the bottom peripheral edge of tube 32. A slight downward force on tube 32 will then seat tube 32 onto tabs 40 aligning and supporting tube 32 in a 90° attitude with respect to base mold 10. At the same time, flaps 30 exert a pressure on the side wall of the tube to maintain it in position and allow for a large contact area between tube 32 and flaps 30 for affixing tube 32 to base mold 10.

If desired, tape 36 may be wrapped around the upstanding flaps 30 to provide for reinforcement of the arrangement. Other means such as screws, clamps or adhesives could likewise be used.

Figure 6:
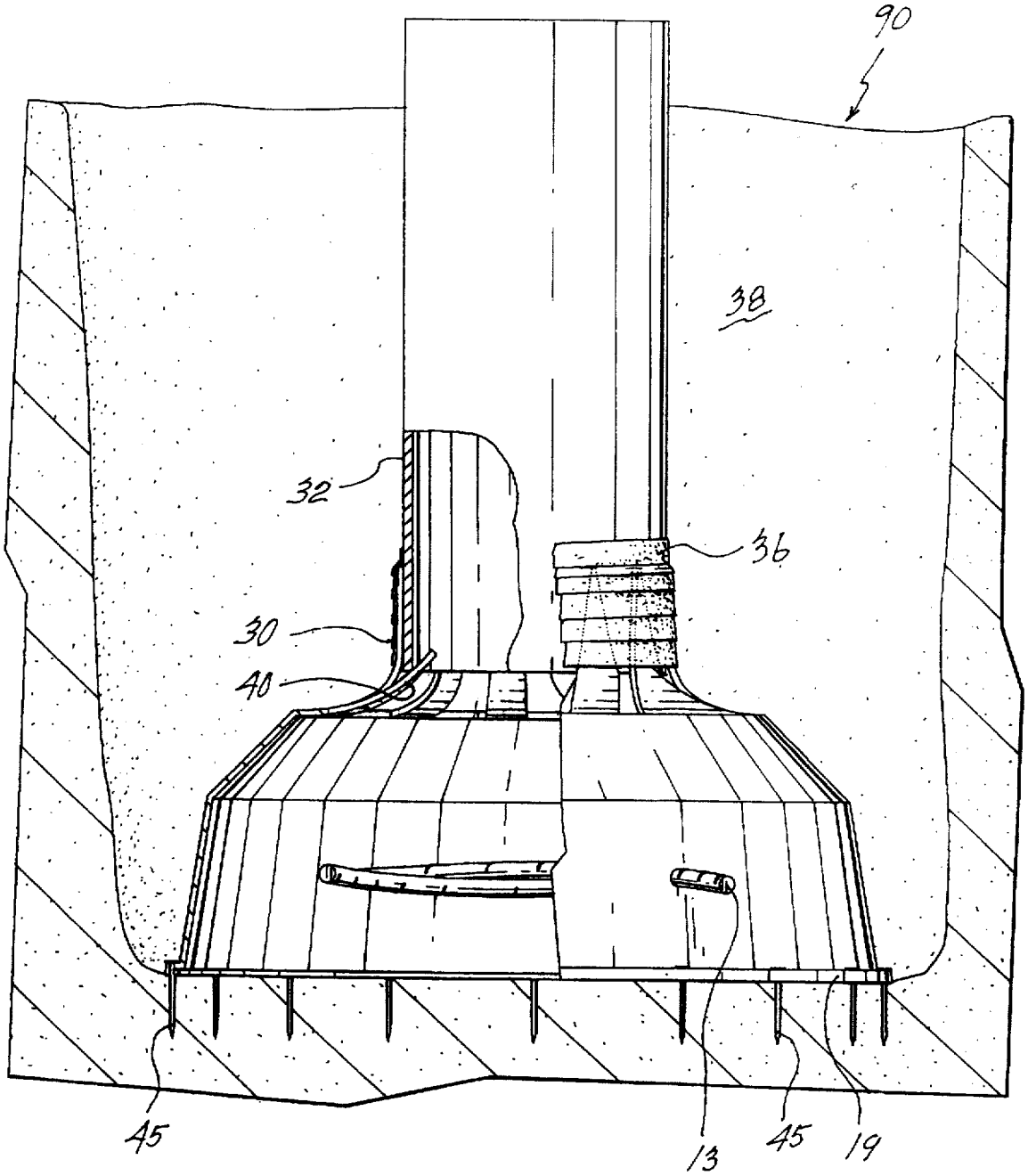
FIG. 6 is a side elevational view, partially in section of the embodiment of FIG. 1 showing the set-up of the mold and post.

Concrete reinforcing bars 13 may be slipped through apertures 29 in side wall 12. The joined base mold 10 and tube 32 can then be placed into the excavation 90. (FIG. 6). Flange 19 will seat within the excavation to help minimize movement of the mold 10.

Subsequently, the concrete post base mold may be pinned in position utilizing large spikes 45 through rim apertures 15 and back fill 38 placed around the arrangement.

Liquid concrete poured into the tube 32 will subsequently fill both the tube 32 and the base mold 10 thereby cast a one piece concrete post with footing.

Figure 2A:
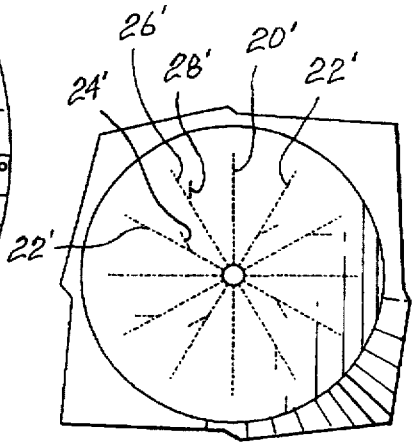
FIG. 2A is a view similar to FIG. 2 showing an alternative indicia embodiment.
Figure 3:
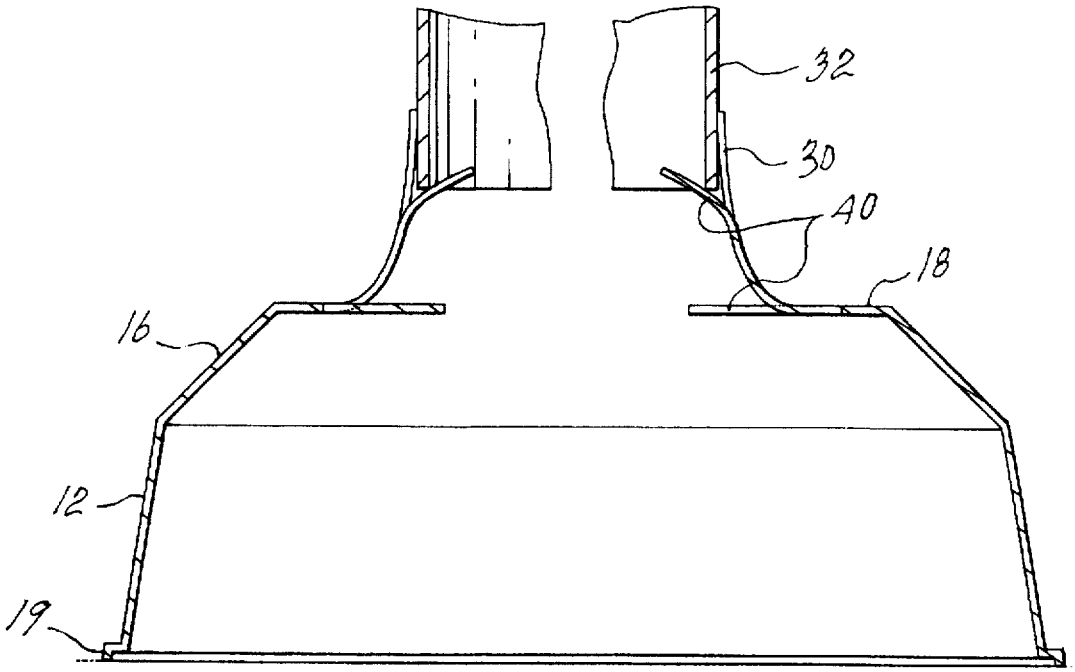
FIGS. 3, 4 and 5 illustrate use of the concrete post base mold.
Figure 4:
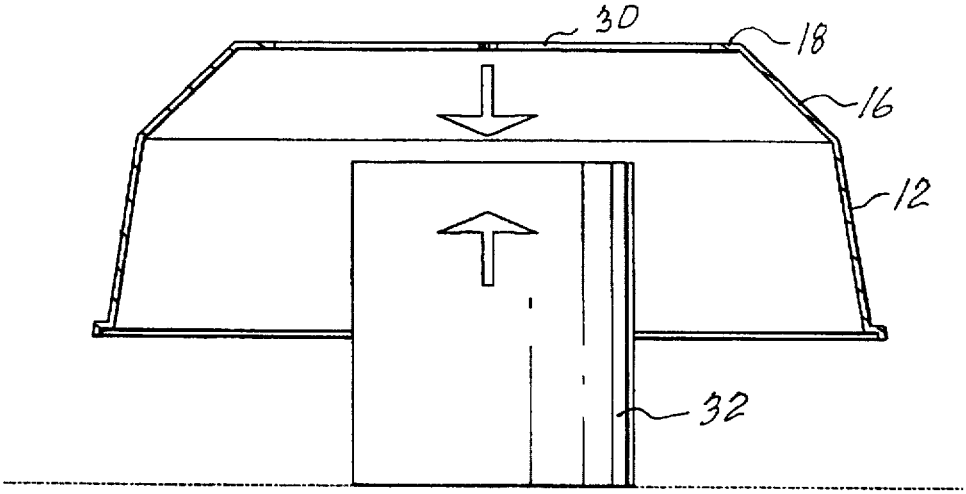
Figure 5:
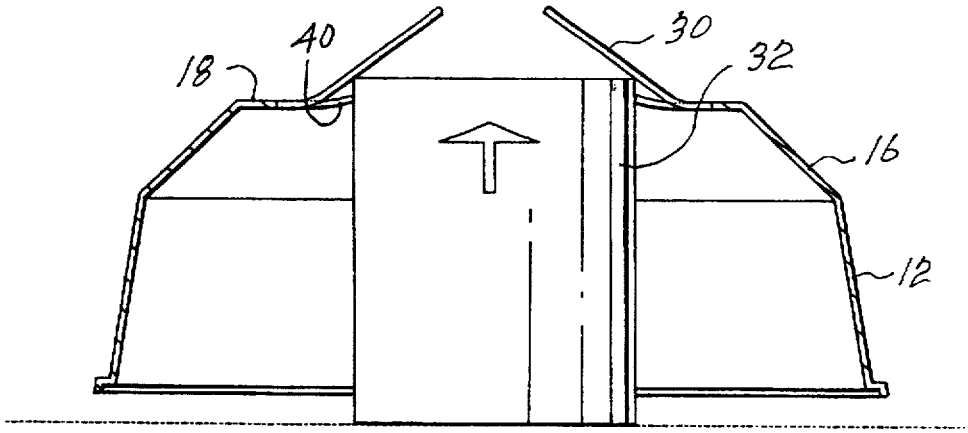

In one alternative embodiment, as indicated in FIG. 2A, in lieu of the slits 20, 22, 24, 26 and 28, score lines 20', 22', 24', 26' and 28' may be formed. The end user would then cut or otherwise perform the slits along the score lines. One could also have indicia in lieu of the score lines.

Figure 8A:
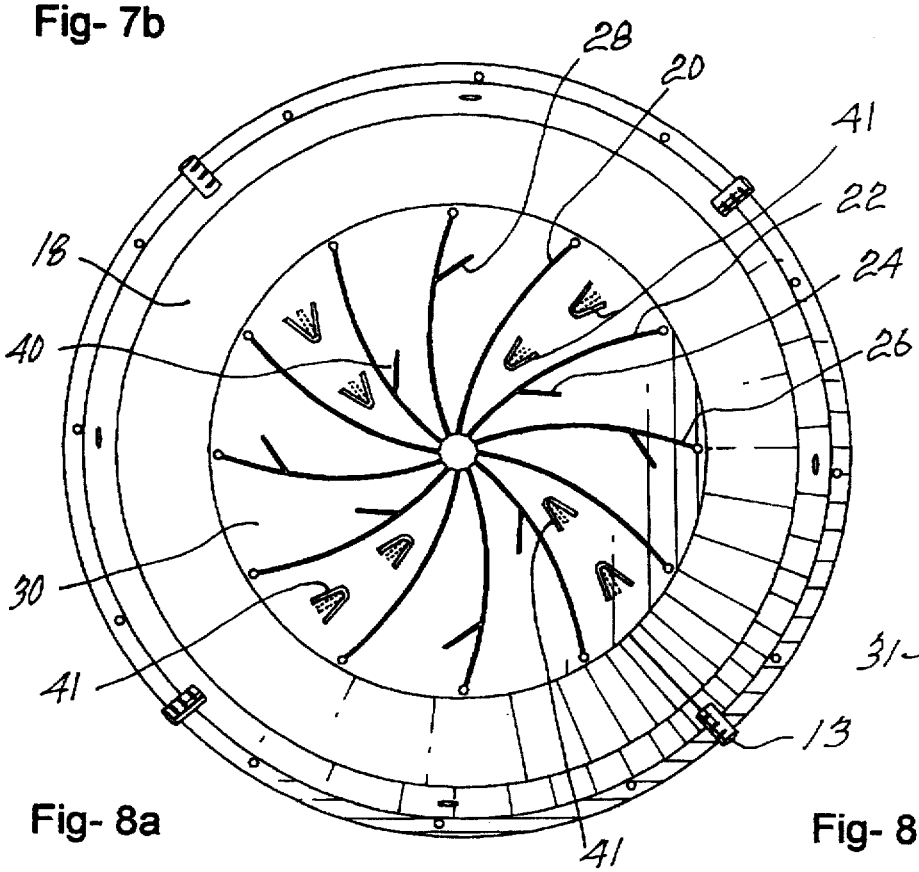
FIG. 8A is a top plan view of a still further embodiment.
Figure 8B:
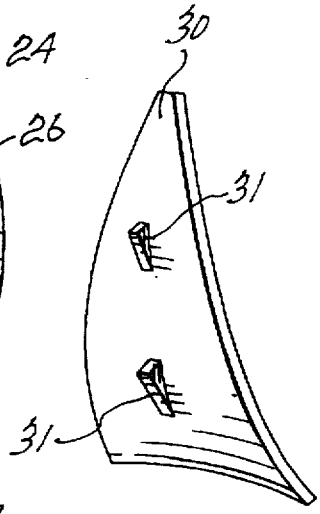
FIG. 8B is a detailed view of an alernative embodiment wherein the protrusions are formed on the underside of the flaps.

In the embodiment of FIG. 8A, it will be noted that radial slits 20, 22 and 26 have an arcuate configuration. In this embodiment, there is illustrated an alternative wherein alignment tabs 41 are formed completely within flaps 30. A still further embodiment is shown in FIG. 8B wherein protrusions 31 are provided on the underside of flaps 30 for engagement with tube 32. Protrusions 31 have an inverted triangular outline as shown in FIG. 8B to provide support for the bottom of tube 32.

Figure 7A:
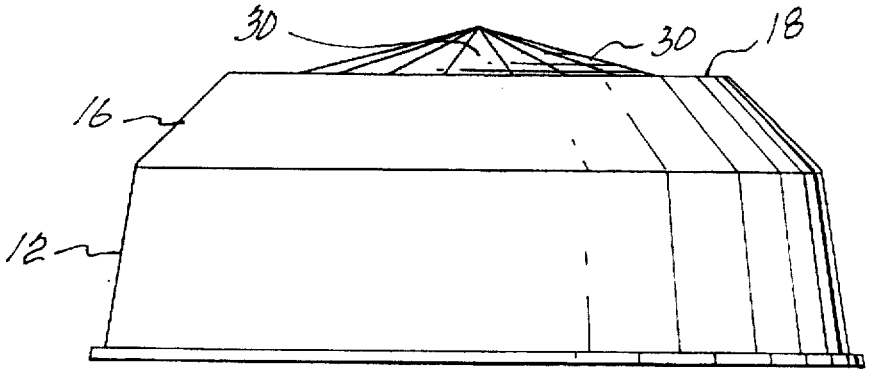
FIG. 7A and 7B are side elevational views of alternative embodiments.

In the embodiment illustrated in FIG. 7A, upper wall 18 has a central portion wherein the flaps 30 are formed to have a triangularly shaped configuration.

Figure 7B:
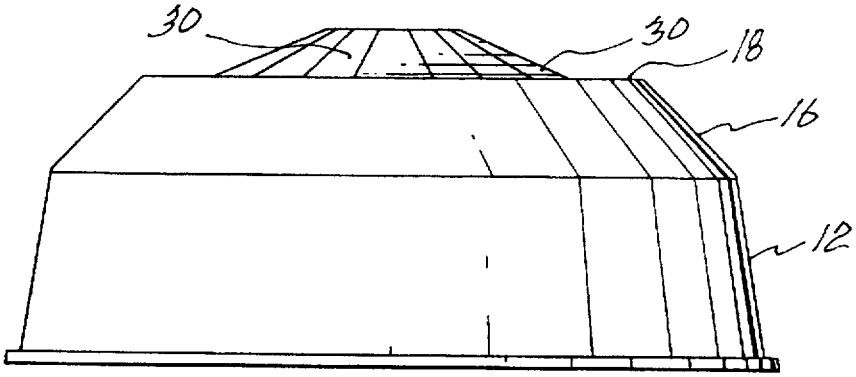

In the embodiment of FIG. 7B, flaps 30 are formed to have a frustroconical configuration.

It will be understood that the above described embodiment is for purposes of illustration only and that changes and modifications may be made thereto without departing from the spirit and scope of the invention.

I claim:

1. A mold suitable for forming a base for a concrete post, said mold comprising a mold member having a side wall portion and a top wall portion, said top wall portion having means for forming a plurality of radially extending main slits extending from a central point to thereby form a plurality of flaps, said top wall portion being formed of a flexible material.

2. The mold of claim 1 wherein said means for forming a plurality of radially extending main slits comprises a plurality of score lines formed on said top wall portion.

3. The mold of claim 1 wherein said means for forming a plurality of radially extending main slits comprises indicia formed on said top wall portion.

4. A mold suitable for forming a base for a concrete post, said mold comprising a mold member having a side wall portion and a top wall portion, said top wall portion having a plurality of radially extending main slits extending from a central point to thereby form a plurality of flaps, said top wall portion being formed of a flexible material.

5. The mold of claim 4 further including at least one slit formed completely within at least one of said flaps to thereby form an alignment tab.

6. The mold of claim 4 wherein said side wall portion is a generally vertical side wall and said top wall portion is substantially horizontal.

7. The mold of claim 6 further including a plurality of reinforcing ribs formed in said side wall.

8. The mold of claim 4 wherein said mold is formed of a plastic material.

9. The mold of claim 6 including an aperture formed in said top wall portion at a central point thereof, said main slits extending radially outwardly from said aperture.

10. The mold of claim 9 wherein said main slits are cut as a straight line.

11. The mold of claim 9 wherein said main slits have an arcuate configuration.

12. The mold of claim 4 further including a base located at a lower periphery of said side wall portion.

13. The mold of claim 4 further including at least one secondary slit formed in at least one of said flap portions, said secondary slit extending from a main slit and thereby forming an alignment tab.

14. The mold of claim 4 further including a plurality of secondary slits formed in said flap portions, said secondary slits being located at varying distances from said central point to form tabs adapted to thereby receive, align and position tubes of different configurations and diameters.

15. The mold of claim 4 further including slits or apertures in said side wall portion to permit entry of reinforcing bars into said base mold.

16. A setup for pouring a concrete post, said setup comprising a mold having a side wall portion and a top wall portion, said top wall portion having a plurality of radially extending main slits extending from a central point to thereby form a plurality of flaps, said top wall portion being formed of a flexible material, a tube extending upward from said mold, said flaps lying adjacent said tube, tabs underneath said tube and retaining said tube in position.

17. The setup of claim 16 wherein said side wall portion has at least a pair of opposed apertures therein, at least one reinforcing bar extending through said apertures.

18. The mold of claim 4 wherein said side wall portion is a generally vertical side wall and the said top wall portion is cone shaped rising above said side wall portion.

19. The mold of claim 4 including at least one molded protrusion formed on an underside of said flaps to act as alignment tabs.

20. The mold of claim 4 including a plurality of molded protrusions on an underside of said flaps at various distances from said central point to thereby form means for aligning a tube form.

21. The mold of claim 9 further including at least one slit formed completely within a plurality of said flaps to thereby form a plurality of alignment tabs.

* * * * *